United States Patent [19]

Seaquist

[11] 4,039,744

[45] Aug. 2, 1977

[54] ELECTRICAL BUS SUPPORT

[75] Inventor: James J. Seaquist, Birmingham, Ala.

[73] Assignee: Square D Company, Park Ridge, Ill.

[21] Appl. No.: 680,007

[22] Filed: Apr. 26, 1976

[51] Int. Cl.[2] ..... H01B 17/40; H01B 17/16

[52] U.S. Cl. ..... 174/169; 248/65

[58] Field of Search ..... 174/144, 149 B, 168, 174/169, 170, 171; 248/55, 65, 74 R

[56] References Cited

U.S. PATENT DOCUMENTS

| | | | |
|---|---|---|---|
| 2,415,649 | 2/1947 | Matthysse | 174/171 |
| 2,616,646 | 11/1952 | Matthysse | 248/65 |

FOREIGN PATENT DOCUMENTS

| | | | |
|---|---|---|---|
| 1,100,125 | 2/1961 | Germany | 174/169 |

OTHER PUBLICATIONS

Delta Star Electric Co. Catalog Bulletin 31-C entitled "Indoor Bus Supports and Fittings" p. 17.

Advertisement entitled "Bus Supports", *Electrical World,* June 15, 1974, p. 85.

*Primary Examiner*—Laramie E. Askin

*Attorney, Agent, or Firm*—Harold J. Rathbun; Carmen B. Patti

[57] ABSTRACT

A three part bus support for supporting a cylindrical tubular bus on an insulator comprises a base and two identical end portions. Each end portion has a hook portion defining an opening and a base portion which is connectible to either of the opposite ends of the base at one of two wall portions formed along opposed ends of the base. When the end portions are connected to the base, the openings defined by the hooks are aligned for receiving a tubular bus. A projection of one end of the base portion of each end portion is tangent to an inner surface of the hook portion where the bus exerts a force caused by wind, and the base is asymmetrical about a longitudinal axis passing through the opposite ends of the base to provide improved locations of fulcrums of lever arms of the wind forces. A pair of leaf springs oriented to prevent abrasion of the bus and received in respective recesses in inner sides of enlarged ends of the hook portions serve as static eliminators to insure that the bus maintains electrical continuity with the support structure during vibration to prevent radio interference problems. The outer surfaces of the hook portions are rounded and smooth to provide improved corona characteristics.

11 Claims, 8 Drawing Figures

ELECTRICAL BUS SUPPORT

BACKGROUND OF THE INVENTION

This invention relates to an improved bus support for supporting an energized cylindrical tubular bus beyond an outer end of an insulator.

Many existing bus supporting structures are made from a single casting. The use of a single casting imposes serious limitations on the design of the structure. For example, the cores used during casting to define the openings in the hooks of the support occasionally shift during the casting operation causing the openings to be in misalignment and the dimensions of the bus support thus to be in error. When this occurs, the bus will not slidably fit within the openings in both hook portions. Also, the use of a single casting restricts the shape of the structure because of the procedure of molding that includes the removal of the cast from the mold. Hence, the most desirable design from a corona standpoint cannot be obtained. Furthermore, in the case of a single casting, recesses in the inner surface of the hook portions which receive static-eliminating leaf springs must be so oriented that the sides of the springs are perpendicular to the longitudinal axis of the bus permitting sharp edges to abrade the bus as it moves longitudinally within the bus support.

Another problem with existing bus supports is of breakage which occurs where the hooks intersect the base and between the perimeter of the base and one of the apertures for bolts which secure the support to the insulator. The breaks occur at these places because forces, such as can be caused by wind, applied along a longitudinal axis of the bus toward an inner side of a hook portion are exerted upon a lever arm defined by the distance between a point of contact of the force on the inner side of the hook portion and a point of rotation at a point along the connection of the hook portion and the base. Thus, the bus support is subjected to a moment which is the product of the force and a relatively short lever arm.

A need exists for an improved bus support design having improved corona and strength characteristics.

SUMMARY OF THE INVENTION

A bus support for holding a tubular bus is designed to be bolted to the end of an insulator. The bus support comprises a base and two separate identical end portions defining hooks. The base is asymmetrical about a longitudinal axis passing through its center and intersecting opposite end portions and wall portions along opposed sides of the base to strengthen the base. The end portions are connectible at the ends of the base, and the base can accommodate end portions having hooks of different sizes. Each hook portion defines an opening for receiving a bus and extends upwardly and laterally from one end of a lower base portion which is connected to the base. The one end is vertically aligned with an inner side of the hook portion where load forces are applied to the bus support by the bus. One side portion of each opposite end portion of the base has a greater lateral displacement from the longitudinal axis and extends beneath the one end to minimize the lever arm and accordingly the moment applied to the support by external forces. The outer sides of the hook portion are smooth and rounded to provide improved corona characteristics. A leaf spring, serving as a static eliminator by insuring that continuous contact is maintained between the bus and the bus support during vibration of the bus, is received within a recess on the under side of the outer end portion of each hook portion. A long dimension of the spring is parallel to the longitudinal axis of the bus so that when the bus slides within the openings in the hooks, only a smooth portion of the spring contacts the bus so that it will not be scratched or gouged by the edge of the spring.

It is an object of this invention to provide an improved bus support for cylindrical buses.

Another object is to provide an improved bus support that slidably receives a bus without risk of scratching the surface of the bus.

A further object is to provide an improved bus support in which the axial openings for receiving a bus are always in alignment.

A still further object is to provide an improved bus support having a base that is connectible to end portions having hook portions of various sizes.

A further object is to provide an improved bus support having a base and hooks that have improved strength characteristics.

A further object is to provide an improved bus support having hook portions cast separately from a base and so assembled that the lever arm of forces applied to the support through the bus are reduced thus providing a bus support that resists breaking.

A further object is to provide a bus support having smooth interior contours that mininize the area of contact with the bus.

BRIEF DESCRIPTION OF THE DRAWINGS

Other objects and advantages of the present invention will become apparent from the following description wherein reference is made to the accompanying drawings, in which.

DETAILED DESCRIPTION OF THE DRAWINGS

Figure 1:
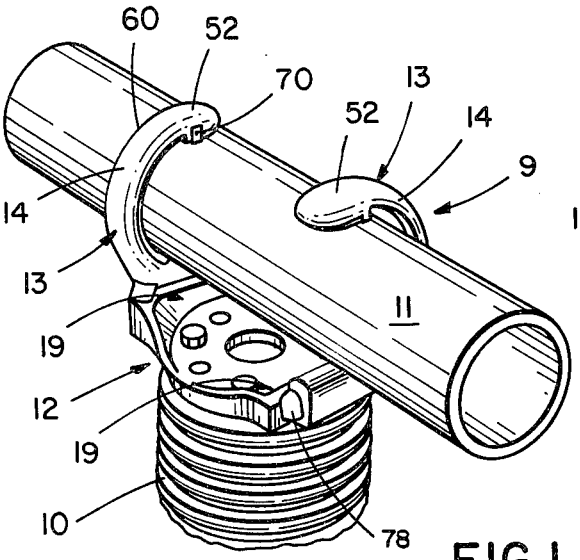
FIG. 1 is a perspective view of a tubular bus support in accordance with the invention connected to an insulator and holding a tubular bus.
Figure 2:
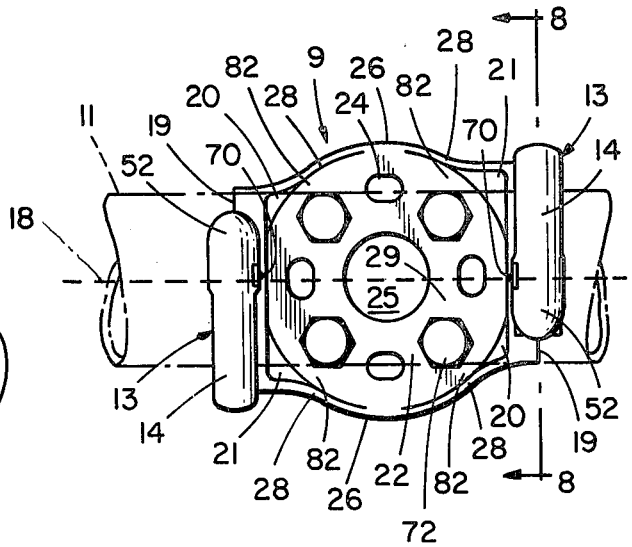
FIG. 2 is a top view of the bus support of FIG. 1.

The bus support, identified by the reference number 9, is shown connected to a support structure, such as an insulator 10, and holding a cylindrical, tubular bus 11. The support 9 comprises a three part casting preferably of an aluminum alloy, including a base 12 and a pair of identical opposed end portions 13 secured to the base 12 as by welding and each having a hook portion 14 and a base portion 15. As seen in FIG. 2, the base 12 is asymmetrical about its longitudinal axis indicated by a dashed line 18. The base 12 has opposed end portions 19 each having side portions 20 and 21 extending laterally from the longitudinal axis 18. The side portions 21 are displaced a greater distance from the longitudinal axis 18 than the side portions 20, and the diametrically opposed side portions 20 and 21 are equivalent. The asymmetrical configuration of the base 12 provides an improved strength characteristics as will be described later.

The base 12 has a central recessed portion 22 provided with a plurality of circumferentially spaced apertures 24 surrounding a central aperture 25. Beginning near a midsectionn of the base 12 on opposite sides of the longitudinal axis 18 and extending in opposite directions longitudinally from the midsection generally parallel to the axis 18 on opposed sides 26 of the base 12 are wall portions 28 each having a generally wedge shape. The wall portions 28 progressively thicken transversely and progressively rise above a flat upper surface 29 of the central portion 22 outwardly from the midsection along the sides 26. At its outer extremities, each wall portion 28 merges into one of two end walls 30 extending upwardly from the central portion 22 at opposite ends of the base 12.

The exterior of each end wall 30 is undercut at 31 to define a flange 32 and a lower exterior wall surface 33. The flanges 32 are generally parallel to the upper surface 29 and each flange has an upper surface 38 and a lower surface 40 each located above the upper surface 29.

The base portions 15 of the end portions 13 each has a groove 46 extending laterally along an inner side 48. Each hook portion 14 extends laterally and upwardly along one end 51 of the base portion 15 and terminates in an enlarged head portion 52. An inner surface 54 of each end portion 13 has a lower portion 55 above the base portion 15 and an upper portion 56 along an inner side of the hook portion 14. The upper portion 56 which is tangential to a vertical projection of the end 51 is represented by the dashed line T in FIG. 3. This relationship between the one end 51 of the base portion 15 and the surface 54 provides an improved strength characteristic as will be described later. The upper surface portion 56 is abbreviated along the sides as at 58 to conserve metal.

Casting the end portions 13 separately from the base 12 permits the hook portions 14 to have varying arc radii R defining openings for accommodating cylindrical buses of various outside diameters. Furthermore, casting the end portions 14 individually does not require the use of cores to define the openings and assures uniform radii of the hook portions 14. Then, when the end portions 13 are assembled on the base 12, the axes through the openings defined by the hook portions 14 are concentric and a cylindrical bus 11 will be received by the openings without an alignment problem. In addition, the separate casting of the end portions 13 allows the contours of each end portion to be rounded. Thus, the upper surface 56 of the inner surface 54 of each hook portion 14, and the lower portion 55 of the inner surface 54 of each base portion 15, as shown in the drawings, has a uniform radius along the entire length of both surfaces to minimize the area of contact of the hook portions 14 with the tubular bus 11, and the surfaces of contact are rounded to avoid damaging the bus, and an outer surface 60 of each hook portion 14 is rounded to provide improved corona characteristics.

A recess 62 in the inner surface 54 of each hook portion 14 beneath the enlarged head portion 52 has its longer dimension parallel to the longitudinal axis 18, and a deeper portion near an outer side of the hook portion 14. A recess 63 extends upwardly along an inner side of the hook portion 14 and intersects the recess 62. A leaf spring 64 having a rounded portion 66 and a tab 68 is received in the recess 62 and is held in place by a screw 70 through the tab and connected within the recess 63. The resilient action of the spring 64 insures that its rounded portion 66 and thus the bus support will remain in constant physical contact with the tubular bus 11 disposed through the hook portion 14. This structure serves as a static eliminator and prevents radio interference.

In assembly of the bus support 9, the base 12 is placed on the top of the insulator 10 and secured thereto by bolts 72 which are inserted through selected ones of the apertures 24 and threaded into respective sleeves 74 within the insulator 10. Generally, as best seen in FIG. 2, four apertures disposed at 45° angles to the longitudinal axis 18 are chosen for the bolts.

After the base 12 is secured to the insulator 10, the end portions 13 are assembled on the opposed end portions 19 of the base 12 by engaging the flanges 32 of the base 12 with respective ones of the grooves 46. The end portions 13 are then permanently secured to the base 12 by welds 78. The welds 78 are required only to hold the end portions 13 in place and not for strength.

The openings defined by the hook portions 14 of the end portions 13 are aligned with the insulator 10 so that a common longitudinal axis extending through the openings and the tubular bus 11 extending through these openings aligns with another portion of the installation, not shown, to which the tubular bus 11 is to be secured.

The bus support 9 may be assembled and connected to the bus 11 after the bus is positioned above the insulator 10, or, alternatively, the bus 11 may be slidably installed through the bus support 9 after the support is assembled and connected to the insulator 10.

Figure 3:
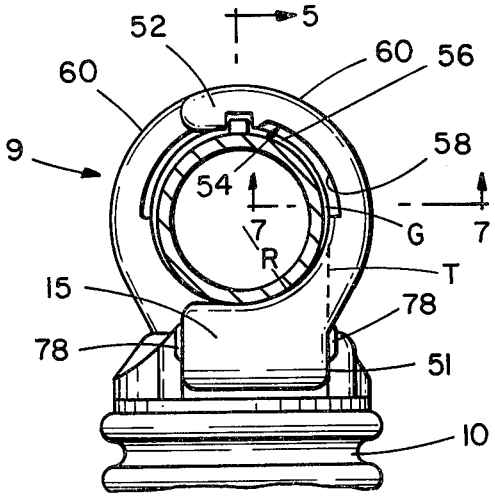
FIG. 3 is an end view of the bus support as viewed from the right of FIG. 2.
Figure 4:
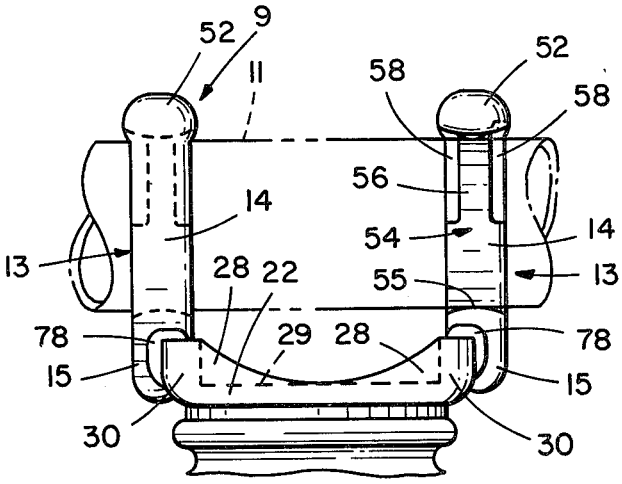
FIG. 4 is a side view of the bus support of FIG. 1 as viewed from the left of FIG. 1.
Figure 5:
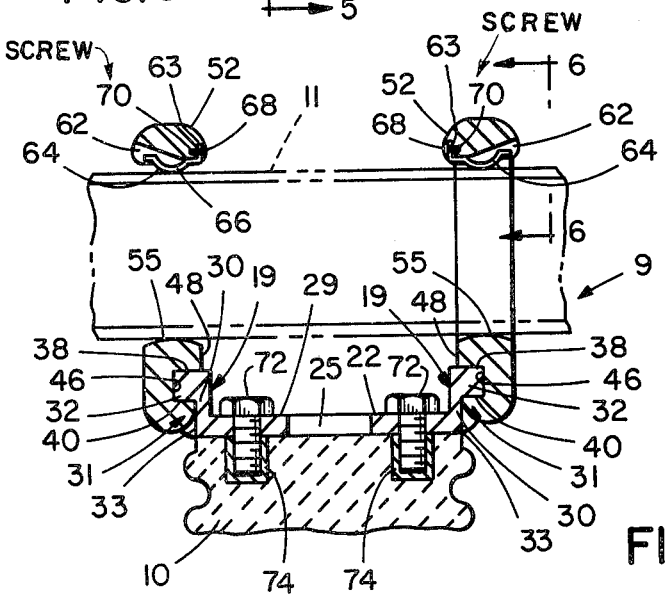
FIG. 5 is a sectional view taken generally along the line 5—5 of FIG. 3.
Figure 6:
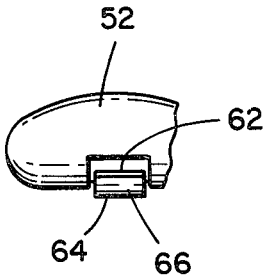
FIG. 6 is a view of an end portion of a hook of the bus support of FIG. 1 showing the positioning of a static eliminator spring.
Figure 7:
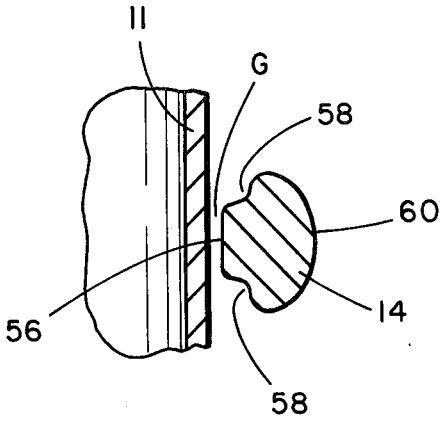
FIG. 7 is a sectional view taken generally along the line 7—7 of FIG. 3.

During no load conditions, the bus 11 rests on the curved lower portions 55 of the inner surfaces 54 of the end portions 13 above the base portion 15. As best seen in FIGS. 3 and 7, the bus 11 does not contact the upper portion 56 along the inner surface 54 of either one of the hook portions 14 as indicated by gap G.

The load exerted upon the bus support 9 during operation is the resultant of forces, such as wind against the bus 11, that is perpendicular to the longitudinal axis 18 and parallel to the upper surface 29 of the central recessed portion 22.

Figure 8:
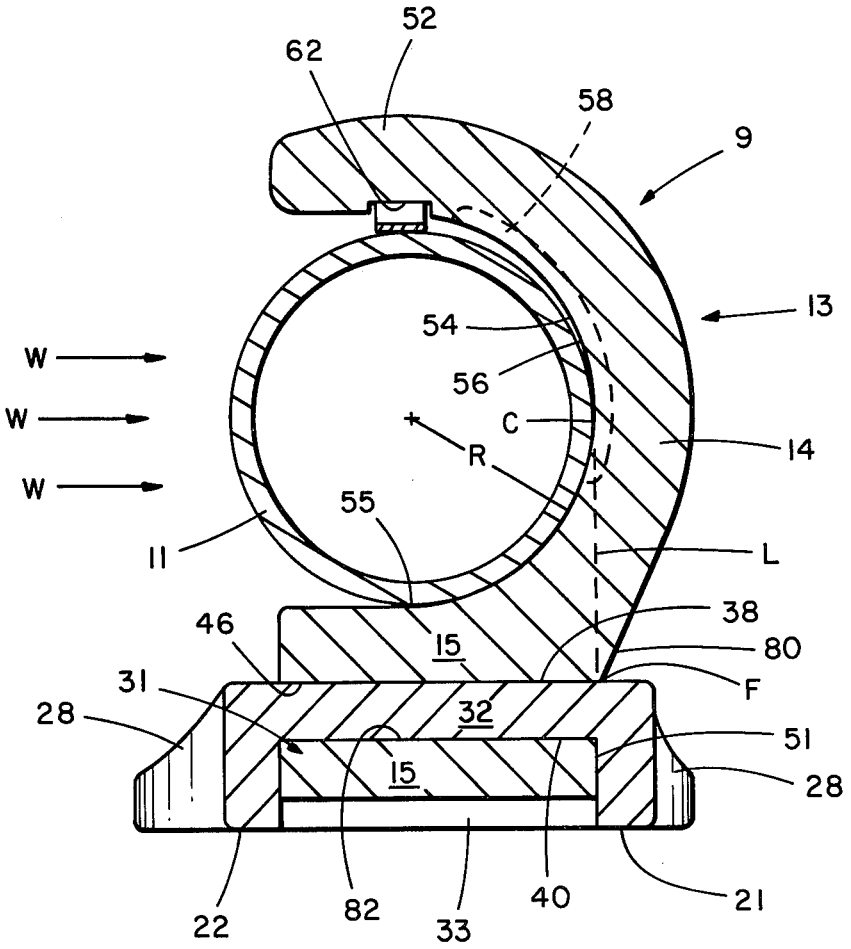
FIG. 8 is a sectional view taken generally along the line 8—8 of FIG. 2 when wind forces exist.

As best seen in FIG. 8, when a wind load W is applied to the bus 11, the bus moves along the lower portion 55 of the inner surface 54 toward the upper portion 56 of the inner surface 54 of one or the other of the hook portions 14 depending upon the wind direction. One of the gaps G then closes and contact is made at C between the upper portion 56 and an outer surface of the bus 11. The force applied at C causes a moment to be exerted about a fulcrum F which is established along a lower outer edge 80 of the one end 51 of the base portion 12 on the upper surface 38 of the flange 32 beneath the contact C. As best seen in FIG. 8, the relatively greater lateral displacement of the one end 51 of the base portion 12 from the longitudinal axis 18 and the tangential alignment of its vertical projection with C establishes the fulcrum F at a point closer to C than existing bus supports thus reducing the lever L arm shown by a dashed line in FIG. 8 and minimizing the moment applied to the bus support about the fulcrum F and thus providing a bus support having improved strength characteristics.

A reactive force which opposes the rotation of the base portion 12 about the fulcrum F is provided by interaction of an upwardly facing side 82 of the groove 46 with lower surface 40 of the flange 32 along the length of the groove 46.

The force applied to the hooks 14 is also transmitted to the connection between the base 12 and the insulator 10. In existing bus supports, the force causes breakage or occur between one of the bolt apertures 24 and the perimeter of the base. The base 12 disclosed in this application resists breaking which typically occurs between a space 82 between one of the bolts 72 and the opposed sides 26 of the base 12 because of the reinforcing strength provided by the wall portions 28.

Variations in ambient temperature cause the bus 11 to expand and contract longitudinally and thus move through the openings defined by the hook portions 14 of the end portions 13. Since the sides of the leaf spring 64 are parallel to the tubular bus 11, the tubular bus is not abraded by the spring because only the rounded portion 66 of the spring 64 contacts the tubular bus and not the side edges of the spring 64.

While the preferred embodiments of the present invention have been shown and described herein, the hook portions may have complete annuli completely encircling the bus. Accordingly, it is obvious that many structural details may be changed without departing from the spirit and scope of the appended claims.

I claim:

1. A bus support for a cylindrical electrical bus comprising a three-part casting including a base adapted to be secured to an insulating support structure and two spaced end portions assembled on respective opposite ends of the base so as to extend upwardly from the base, the end portions having respective substantially circular openings therethrough which are axially aligned with each other for slidably receiving and retaining the bus, and connecting means connecting the end portions to the base, including outwardly directed, horizontally aligned flanges at the opposite ends of the base, respectively, and complementary grooves in respective base portions of the end portions receiving the flanges, respectively.

2. A bus support as claimed in claim 1 wherein the end portions have smooth and curved outer surfaces for limiting the occurrence of corona when the bus support is used to support a high voltage bus.

3. A bus support as claimed in claim 1 wherein the openings are defined by respective hook portions extending laterally and upwardly from respective base portions of the end portions, each hook portion partially encircling a bus when a bus is supported by the support.

4. A bus support as claimed in claim 3 wherein the end portions are identical and one hook portion extends laterally and upwardly at one side of the base and the other hook portion extends laterally and upwardly from the other side of the base.

5. A bus support as claimed in claim 4 wherein the side of each base portion from which its associated hook portion extends is disposed at the adjacent end of the flange on which the end portion is assembled and is vertically aligned with a point along an inner surface of the associated hook portion where a resultant force caused by wind is applied through the bus to the hook portion so that the distance between said point and a fulcrum defined by contact between an upper end edge of the groove in the base portion and an upper surface of the flange is minimized thus minimizing the turning moment applied to the end portion.

6. A bus support as claimed in claim 5 wherein the base is asymmetrical about a longitudinal axis extending through the openings, one side of each opposite end of the base having a greater displacement from the longitudinal axis than the other side, the hook portions extending laterally and upwardly respectively from the sides of the base having the greater displacement.

7. A bus support as claimed in claim 5 wherein end walls extend upwardly from an upper surface of the base at respective opposite ends of the base, and wall portions extend from the upper surface of the base upwardly and along opposite sides thereof and intersect inner sides of the end walls thereby to resist breakage of the base as the moment is applied to the end portions.

8. A bus support as claimed in claim 3 wherein the opening defined by each hook portion has a radius selected so that an outer surface of a bus received within the opening is juxtaposed to an inner side surface of the hook portion.

9. A bus support for a cylindrical electrical bus comprising a three-part casting including a base adapted to be secured to an insulating support structure and two spaced end portions assembled on respective opposite ends of the base so as to extend upwardly from the base, the end portions having respective substantially circular openings therethrough which are axially aligned with each other for slidably receiving and retaining the bus, the openings being defined by respective hook portions extending laterally and upwardly from respective base portions of the end portions, each hook portion partially encircling a bus when a bus is supported by the support, a recess formed in an underside of an outer end portion of each hook portion, and a spring member disposed at each recess, each spring member having a rounded portion extending beyond the inner surface of its associated hook portion for contacting the bus thereby to provide electrical continuity between the bus support and the bus for eliminating radio interference, and connecting means connecting the end portions to the base.

10. A bus support as claimed in claim 9 wherein each spring member is an elongated strip of metal extending longitudinally of the bus support.

11. A bus support for a cylindrical electrcial bus comprising a three-part casting including a base adapted to be secured to an insulating support structure and two spaced end portions assembled on respective opposite ends of the base so as to extend upwardly from the base, the end portions having respective substantially circular openings therethrough which are axially aligned with each other for slidably receiving and retaining the bus, the openings being defined by respective hook portions extending laterally and upwardly from respective base portions of the end portions, each hook portion partially encircling a bus when a bus is supported by the support and having a radius selected so that an outer surface of a bus received within the opening is juxtaposed to an inner side surface of the hook portion, the upper surface of each base portion and the inner surface of each hook portion being uniformly curved with a substantially constant radius along the length thereof to prevent damage to a bus slidably moving through the opening, and connecting means connecting the end portions to the base.

* * * * *